United States Patent [19]

Bicicchi et al.

[11] 4,058,417

[45] Nov. 15, 1977

[54] TURBINE BUCKET ALLOY

[75] Inventors: Richard Thomas Bicicchi, Boxford; Albert Samuel Melilli, Winchester, both of Mass.

[73] Assignee: General Electric Company, Schenectady, N.Y.

[21] Appl. No.: 679,700

[22] Filed: Apr. 23, 1976

Related U.S. Application Data

[63] Continuation of Ser. No. 552,515, Feb. 24, 1975, abandoned.

[51] Int. Cl.[2] ..... C22C 38/44

[52] U.S. Cl. ..... 148/37; 75/128 W; 148/12 EA

[58] Field of Search ..... 148/37, 128 R, 128 W, 148/12 EA

[56] References Cited

U.S. PATENT DOCUMENTS

| | | | |
|---|---|---|---|
| 2,891,859 | 6/1959 | Kegerise | 148/37 |
| 3,288,611 | 11/1966 | Lula et al. | 148/37 |
| 3,355,280 | 11/1967 | Tuffnell et al. | 75/128 R |
| 3,378,367 | 4/1968 | Friis et al. | 148/37 |
| 3,385,740 | 5/1968 | Baggstrom et al. | 148/37 |
| 3,663,208 | 5/1972 | Kirby et al. | 75/128 W |
| 3,767,388 | 10/1973 | Asakura | 75/128 W |
| 3,933,479 | 1/1976 | DeFilippii et al. | 148/37 |

FOREIGN PATENT DOCUMENTS

| | | | |
|---|---|---|---|
| 1,214,293 | 12/1970 | United Kingdom | 148/37 |

*Primary Examiner*—Arthur J. Steiner

*Attorney, Agent, or Firm*—John F. Ahern; James W. Mitchell

[57] ABSTRACT

Relates to wrought forged turbine bucket alloys comprising martensitic stainles steel free from ferrite and having critical amounts of chromium, nickel and carbon.

3 Claims, No Drawings

TURBINE BUCKET ALLOY

This is a continuation of application Ser. No. 552,515, filed Feb. 24, 1975, now abandoned.

BACKGROUND OF THE INVENTION

Stainless steel alloys containing 13% chromium are known. An article by Georg Fischer-Aktiengesellschaft, Schaffhausen (Schweiz) and prepared for publication in the Revue de la Metallurgie, July/August 1966 relates to a high strength 13% chromium cast steel of improved weldability. The author discusses the modification of the classical 13% chromium steel to improve its weldability. His alloy composition contains C 0.04–0.06%
Cr 12–13%
Ni 3.5–3.9%
Mo 0.5%

The author concludes that the following cast steel composition presents undeniable advantages in comparison with the classical 13% chromium steel:

C (max.) 0.06%
Cr 12.5%
Ni 3.8%
Mo 0.5%

Another article is that of the Esco Corp. of Portland, Oreg. The article is entitled Alloy Notebook No. 13 and contains C 0.08% max.
Mn 1.50% max.
Si 1.50% max.
Cr 11–14%
Ni 3.0–4.5%
Mo 1.00% max.
Fe — Balance However, the specific alloy that Esco apparently uses contains 13% chromium and 4% nickel and is known as Alloy 13–4.

Reference is also made of U.S. Pat. Nos. 3,378,367 — Lars Eije Friis et al. and 3,385,740 — Baggstrom et al. These patents disclose steel alloys containing 11–14% chromium and 4–8% nickel. U.S. Pat. No. 3,378,367, however, relates to steel which is martensitic in structure but contains dispersed austenite. U.S. Pat. No. 3,385,740 discloses an austenitic-martensitic steel.

Another alloy is known which contains 11.25–13% chromium, 0.06 to 0.15% C and .20% molybdenum. However, the alloy contains only 0.50% nickel (max.). Such alloys are essentially the same as AISI 410 stainless steel.

The prior art states that the content of chromium can be lowered somewhat, see the article by Georg Fischer, if the carbon content is low. If silicon is present it must be limited to prevent the formation of ferrite. If the nickel content is increased a martensitic microstructure is obtained.

Unexpectedly, applicants have discovered an alloy, which falls within an area of the prior art, but which gives better high strength and high toughness than those of the prior art, and which is highly adaptable for making stainless steel forgings and turbine buckets.

SUMMARY OF THE INVENTION

It is therefore an object of our invention to provide a higher strength and increased toughness stainless steel alloy having critical amounts of carbon, chromium and nickel.

It is also an object of our invention to provide an alloy for forgings and turbine buckets having a martensitic structure and free from ferrite.

Briefly stated, the present invention relates to an alloy having the following composition weight percent:

Carbon: 0.05–0.07
Manganese: 0.70–1.00
Silicon: 0.30–0.50
Phosphorus max.: 0.020
Sulfur-max.: 0.020
Nickel: 3.50–4.25
Chromium: 11.20–12.25
Molybdenum: 0.30–0.50
Tin: 0.03 max.
Aluminum: 0.03 max.
Vanadium: 0.03 max.
Iron: Balance A preferred embodiment of the alloy would contain 12% chromium, 4% nickel, and 0.05% carbon. This alloy will hereinafter be identified as B50AH7 and form a basis for the tests referred to hereinafter. The chromium content may be lowered and the carbon and nickel contents may be raised within the ranges specified. For example, the chromium content may be 11.2%, carbon 0.07%, and nickel 4.25%.

Forged turbine buckets were formed from the stainless steel forging material and were produced by the closed die forging process. The forgings were subjected to an austenitized quench and temper heat treatment which involved heating to a temperature of 1750° ± 25° F. and held at the temperature for a minimum of 2 hours or 45 minutes per inch. The forgings were then quenched in oil until the surface temperature was below 212° F. and then tempered at a temperature of 1025° F. ± 25° F. for a minimum tempering time of 2 hours. This was followed by air cooling at room temperature. Straightening of forgings is permitted provided the straightening operation is followed by a stress relieving treatment. Stress relieving is accomplished by uniformly heating to 950° ± 25° F. and held at that temperature for a minimum of 6 hours. The forgings are then air cooled to room temperature. There may be variations in the time and temperature relationship as shown in Table II, Lots A and B, noted below.

The results of the various tests performed on forgings prepared from alloy B50AH7 are shown in the following tables Heat treatment given the material before machining into test specimens are shown in Table I. Lot A followed the heat treatment and resulted in the following mechanical properties: 145ksi tensile strength, 131.4 ksi 0.2% yield strength, 113.3 ksi 0.02% yield strength, 69.3% RA, 18.5% elongation (2 inches). Stress rupture, tensile, erosion and fatigue specimens were obtained from lot A. Stress corrosion and Goodman diagram specimens were heat treated in accordance with the alloy shown as lot B in this table. Hardness of material so treated was $R_c$ 31 which is approximately 144 ksi tensile strength.

TABLE I

| Heat Treatment of B50AH7 | | | |
|---|---|---|---|
| Lot A: | Austenitize Oil Quench | 1750° F. | 2 hrs. |
| | Temper Air Cool | 1000° F. | 3 hrs. |
| | Temper Air Cool | 1050° F. | 5 hrs. |
| Lot B: | Austenitize Oil Quench | 1750° F. | 2 hrs. |

TABLE I-continued

| Heat Treatment of B50AH7 | | |
|---|---|---|
| Temper | 1023° F. | 2 hrs. |
| Fan Quench | | |

The smooth stress rupture properties of B50AH7 are presented in Table II.

TABLE II

| Smooth Stress Rupture of B50AH7 | | | | | |
|---|---|---|---|---|---|
| Stress,** ksi | Temp. ° F. | Time, hrs. | P*, $\times 10^{-3}$ | El, % | R.A., % |
| 60 | 850 | 915.6 | 36.62 | 13 | 76 |
| 40 | 950 | 90.2 | 38.00 | 17 | 79 |
| 35 | 950 | 171.3 | 38.39 | 21 | 84 |
| 27 | 975 | 208.0 | 39.19 | 30 | 90 |
| 20 | 1000 | 579.0 | 40.52 | 33 | 89 |

*P - Larson - Miller Parameter = (° F. + 459.6) (25 + log t).
**Lab Serial No. 970.

Results of elevated temperature tensile tests are presented in Table III. It is observed that strength properties decreased gradually with increasing temperature up to 800° F. above which tensile and yield strengths decreased more markedly. Ductility and Young Modulus between 70° F. and 1000° F. are also shown.

TABLE III

| Elevated Temperature Tensile Properties of B50AH7 | | | | | |
|---|---|---|---|---|---|
| Test Temperature, ° F. | 75 | 400 | 600 | 800 | 1000 |
| T.S., ksi | 136.0 | 125.7 | 119.0 | 109.0 | 84.5 |
| .2% Y.S., ksi | 125.7 | 118.0 | 109.5 | 101.5 | 76.0 |
| .02% Y.S., ksi | 110.8 | 106.5 | 101.7 | 82.0 | 51.0 |
| Elong, % | 21.0 | 18.5 | 17.0 | 17.0 | 22.0 |
| R.A., % | 73.3 | 69.7 | 69.3 | 71.9 | 79.3 |
| Young's Modulus, psi $\times 10^6$ | 29.6 | 29.4 | 27.9 | 26.1 | 24.0 |

Results of cavitation erosion tests of 100 hour duration are presented in Table IV.

TABLE IV

| Cavitation Erosion | | |
|---|---|---|
| Sample | Exposure Time, hours | Weight Loss, grams |
| B50AH7 $R_c$ 32 | 2 | .006 |
| | 5 | .024 |
| | 11 | .058 |
| | 19 | .098 |
| | 40 | .154 |
| | 64 | .189 |
| | 89 | .216 |
| | 100 | .229 |

Estimated endurance limit with a mean stress of 70 ksi (approximately one-half of the tensile strength) was a maximum of ± 78 ksi. Individual test bar results are shown in Table V. This Goodman diagram datum point suggests that the B50AH7 alloy has high resistance to fatigue cracking even with a mean tensile stress of nearly one-half the tensile strength.

The Goodman Diagram point was determined by applying a static tensile load to cylindrical specimens then rotating each specimen with an end load giving a preselected alternating stress at the specimen gage length surface. Assuming elastic behavior, the maximum stress at the outer surface is the sum of the static tensile stress plus the alternating stress. But when this sum is greater than the yield stress, such as in the case here, the surface plastically deforms during the initial cycle. This results in a residual compressive stress on the outer surface and the actual maximum stress at the surface is reduced from the calculated stress by the amount of residual stress.

TABLE V

| Goodman Diagram Data for B50AH7 | | | |
|---|---|---|---|
| | Mean Tensile Stress = 70 ksi | | |
| Sample | Alternating stress, ± ksi | Break or Runout | Cycles $\times 10^{-6}$ |
| G1 | 47 | 0 | 15.2 |
| G2* | 57 | 0 | 17.9 |
| G2* | 77 | 0 | 10.2 |
| G2* | 97 | X | .116 |
| G3 | 90 | X | .128 |
| G4 | 81 | X | .145 |
| G5 | 77 | 0 | 10.4 |
| G6 | 79 | X | .181 |

*Sample G2 was step loaded.

Table VI presents the results of a staircase fatigue endurance limit determination at 800° F. The mean endurance limit was found to be ± 63.3 ksi which represents only about a 20% decrease in fatigue strength from that at room temperature. Fatigue-to-tensile strength ratio of 800° F. was determined to be 0.57. In the conventional bucket material the fatigue strength is 32% less than shown in Table VI.

TABLE VI

| 800° F. Fatigue Endurance Limit of B50AH7 | | | |
|---|---|---|---|
| Sample | Alternating Stress, ksi | Break or Runout | Cycles, $\times 10^{-6}$ |
| H 10 | 60 | 0 | 10.28 |
| H 10* | 65 | X | 9.76 |
| H 11 | 60 | 0 | 10.59 |
| H 12 | 65 | 0 | 37.93 |
| H 13 | 70 | X | .334 |
| H 14 | 65 | X | .632 |
| H 15 | 60 | X | .131 |

*Sample H 10 was step-loaded.

Bucket ZY654, for example in Table VII, was received in a properly tempered and stress relieved condition. It was cut into Charpy Blanks and given an embrittling treatment at 870° F. for 6 hours. Impact bars were then machined and tested to determine the susceptibility of properly stress relieved B50AH7 to subsequent embrittlement. Portions of bucket ZY654 were reaustenitized and tempered. Charpy Blanks were machined and reheated to 875° F. for 6 hours, furnace cooled to 650° F. then air cooled to embrittle the material. A deembrittling treatment of 1000° F. for 2 hours followed by fan quench was given to some of the embrittled B50AH7 and the effect of the treatment measured with room temperature Charpy impact tests.

Bucket ZY2715, for example, was cut up to provide 0.505 inch gage diameter tensile bars from the mid-vane portion and the dovetail portion. Testing was performed at room temperature. Four Charpy V notch bars were obtained from the mid-vane and four from the dovetail. The specimens were oriented axially with the notch axis perpendicular to the forging plane. Room temperature impact energy and 50% FATT were determined.

The tensile properties of mid-vane and dovetail are shown in Table VII. The tensile strength (137.5 ksi) and 0.2% yield strength (128 ksi) are identical in both vane and dovetail while the 0.02% yield strength of the vane, 111.8 ksi is somewhat lower than the dovetail, 115.5 ksi. Ductility of the dovetail was slightly greater than the vane, as shown in the table. Tensile properties from both sections exceeded B50AH7 specification minimums.

TABLE VII

| Vendor Reports | Tensile Strength ksi | .02% Y.S., ksi | .2% Y.S., ksi | El(2") % | R.A. % | R.T. Impact Energy ft-lbs. |
|---|---|---|---|---|---|---|
| Zy 2602 (Samples) | 138.4 | 116.8 | | 20 | 70 | 93 |
| Zy 2654 (Samples) | 141.9 | 118.4 | | 20 | 69 | 92 |
| Zy 2706 (Samples) | 141.4 | 121.2 | | 20 | 69 | 95 |
| Average | 140.6 | 118.8 | | 20 | 69 | 93 |
| M&P Laboratory | | | | | | |
| ZY 2715 Dovetail (Samples) | 137.5 | 115.5 | 128.0 | 20 | 67 | >117 |
| ZY 2715 Vane (Samples) | 137.5 | 111.8 | 128.0 | 19 | 63 | 77 |
| B50AH7 Specification (Samples) | 130–155 | 100–125 | | 15 min. | 60 min. | 60 min. |

Results of the FATT determinations from mid-vane and dovetail locations are given in Table VIII. Room temperature impact energy of the dovetail was greater than the vane and both were above the specification minimum. The FATT of the vane, 8° F. is some 34° F. above that of the dovetail.

TABLE VIII

| Charpy V-Notch Impact of B50AH7 | | | | |
|---|---|---|---|---|
| Location | Test Temp. ° F. | Absorbed Energy ft-lbs | Fibrosity, % | 50% FATT ° F. |
| Mid-Vane | −20 | 22 | 21 | +8 |
| | 0 | 40 | 53 | |
| | 25 | 34 | 56 | |
| | 70 | 77 | 100 | |
| Dovetail | −40 | 30 | 31 | −26 |
| | −20 | 72 | 67 | |
| | 0 | 77 | 77 | |
| | 70 | >117 | 100 | |

The longitudinal fatigue endurance limits of the vane and dovetail were found to be ± 73.5 ksi and ± 77.5 ksi, respectively. Individual test results are shown in Table IX. The fatigue-to-tensile strength ratio for both parts of the forging are above the usually assumed value of 0.5 being 0.53 in the vane and 0.56 in the dovetail.

TABLE IX

| Room Temperature Fatigue Endurance Limit of B50AH7 | | | | | |
|---|---|---|---|---|---|
| Dovetail | | | Vane | | |
| Alternating Stress, ksi | Break or Runout* | Cycles, × $10^{-6}$ | Alternating Stress, ksi | Break or Runout* | Cycles × $10^{-6}$ |
| 70 | O | 10.09 | 70 | O | 10.08 |
| 75 | O | 10.17 | 75 | X | 1.61 |
| 80 | X | .30 | 70 | O | 10.38 |
| 75 | X | .88 | 75 | O | 10.01 |
| 70 | O | 10.38 | 80 | X | .42 |
| 75 | O | 34.21 | 75 | X | .77 |
| 80 | X | 1.10 | 70 | O | 11.27 |
| 75 | X | 1.07 | 75 | X | .22 |
| 70 | O | 20.63 | 70 | O | 20.83 |
| 75 | O | 31.88 | 75 | X | .66 |
| 80 | X | 1.82 | | | |
| 75 | O | 10.27 | | | |
| 80 | O | 10.02 | | | |
| 85 | O | 10.08 | | | |
| 90 | X | .24 | | | |
| 85 | X | 1.09 | | | |
| Endurance limit = ± 77.5 ksi | | | Endurance limit = ± 73.5 ksi | | |

*BreaK - X
Runout - O

The results of room temperature Charpy V-notch impact tests of embrittled B50AH7 are given in Table X. Some of the data in Table X are recorded as zero hold time. These were specimens which were heated to within 5° F. of the recorded embrittling temperature then quenched.

TABLE X

| Effect of Stress Relief Conditions on Charpy Properties of B50AH7 | | | | | |
|---|---|---|---|---|---|
| Temp. ° F. | Hold Time hrs. | Specimen No. | Impact Energy ft-lbs | Fibrosity % | Hardness Rc |
| 600 | 6 | 4U | 49* | 55 | 29.1 |
| 650 | 6 | 4T | 57* | 63 | 30.0 |
| 700 | 6 | 4S | 51* | 59 | 30.6 |
| 750 | 6 | 4R | 53* | 56 | 31.0 |
| 800 | 0 | 9A | 82 | 72 | 29.4 |
| 800 | .2 | 9B | 103 | 98 | 30.0 |
| 800 | .5 | 9C | 68 | 70 | 29.1 |
| 800 | 1.8 | 9D | 52* | 56 | 30.5 |
| 800 | 6 | 3E1 | 32* | 39 | 29.7 |
| 800 | 6 | 3E2 | 32* | 44 | 29.9 |
| 800 | 17 | 9E | 35* | 31 | 30.1 |
| 825 | 6 | 3D1 | 54* | 53 | 30.5 |
| 825 | 6 | 3D2 | 30* | 40 | 30.8 |
| 850 | 6 | 3C1 | 35* | 40 | 30.2 |
| 850 | 6 | 3C2 | 33* | 40 | 29.9 |
| 875 | 0 | 4R1 | 102 | 100 | 30.0 |
| 875 | 0 | 4R2 | 96 | 100 | 29.5 |
| 875 | 0 | 4A1 | 102 | 100 | 30.0 |
| 875 | 0 | 4A2 | 109 | 100 | 29.3 |
| 875 | 0 | 9A | 72 | 78 | 20.7 |
| 875 | .2 | 9B | 69 | 76 | 30.7 |
| 875 | .5 | 9C | 68 | 77 | 30.0 |
| 875 | 1.7 | 9D | 40* | 53 | 30.4 |
| 875 | 6 | 3F3 | 34* | 45 | 30.1 |
| 875 | 6 | 3F4 | 34* | 35 | 30.6 |
| 875 | 17 | 9E | 32* | 40 | 30.4 |
| 900 | 6 | 3B1 | 37* | 40 | 29.8 |
| 900 | 6 | 3B2 | 33* | 35 | 30.0 |
| 910 | 6 | 3W | 53* | 53 | 30.2 |
| 920 | 6 | 3X | 35* | 44 | 29.3 |
| 925 | 0 | 4A | 83 | 81 | 30.1 |
| 925 | 2 | 4B | 55* | 62 | 30.1 |
| 925 | .5 | 4C | 52* | 59 | 30.1 |
| 925 | 1.7 | 4D | 39* | 48 | 30.4 |
| 925 | 6 | 4F | 45* | 56 | 29.2 |
| 925 | 17 | 4E | 89 | 81 | 29.9 |
| 930 | 6 | 3Y | 53* | 61 | 31.5 |
| 940 | 6 | 3Z | 73 | 78 | 30.3 |
| 950 | 6 | 3A1 | 65 | 91 | 29.5 |
| 950 | 6 | 3A2 | 79 | 81 | 29.9 |
| 975 | 1.5 | 9M | 55* | 72 | 29.9 |
| 975 | 6 | 9N | 59* | 75 | 29.5 |

TABLE X-continued

Effect of Stress Relief Conditions on Charpy Properties of B50AH7

| Temp. ° F. | Hold Time hrs. | Specimen No. | Impact Energy ft-lbs | Fibrosity % | Hardness Rc |
|---|---|---|---|---|---|
| 875 | 6(1) | 3S1 | 22* | 26 | 30.7 |
| 875 | 6(1) | 3S2 | 24* | 21 | 30.4 |
| 875 | 6(2) | 4S1 | 40* | 52 | 30.8 |
| 875 | 6(2) | 4S2 | 51* | 53 | 29.8 |
| 1000 | 2(3) | 4T1 | 101 | 99 | 29.5 |
| 1000 | 2(3) | 4T2 | 99 | 100 | 29.1 |
| 1000 | 3(3) | 4C1 | 109 | 100 | 29.9 |
| 1000 | 3(3) | 4C2 | 95 | 100 | 28.5 |

(1)Furnace cooled to R.T.
(2)Furnace cooled to 650° F. then air cooled
(3)Treatment (2) followed by deembrittlement treatment at 1000F.
*Below B50AH7 specification minimum of 60 ft-lbs.

Although the present invention has been described in connection with specific examples and embodiments, it will be readily understood by those skilled in the art the variations and modifications of which the invention is capable without departing from its broad scope.

What is claimed is:

1. A forged turbine bucket formed from an alloy having a martensitic structure and free from ferrite throughout, said alloy consisting essentially of:

| Element | Weight Percent |
|---|---|
| Carbon | .05 - .07 |
| Manganese | .70 - 1.00 |
| Phosphorus | .020 max. |
| Sulphur | .020 max. |
| Silicon | .30 - .50 |
| Nickel | 3.50 - 4.25 |
| Chromium | 11.20 - 12.25 |
| Molybdenum | .30 - .50 |
| Aluminum | .03 max. |
| Vanadium | .03 max. |
| Tin | .03 max. |
| Iron | Remainder |

the forged alloy product being characterized by a yield strength (0.02% — offset) in excess of 100,000 psi and a tensile strength in excess of 130,000 psi.

2. The turbine bucket of claim 1, wherein the chromium content is 12%, nickel 4% and carbon 0.05%.

3. The turbine bucket of claim 1, wherein the chromium content is 11.2%, carbon 0.07% and nickel 4.25%.

* * * * *